United States Patent [19]

Pugner

[11] 4,053,200

[45] Oct. 11, 1977

[54] CABLE CONNECTOR

[75] Inventor: Stephen William Pugner, Bethel, Conn.

[73] Assignee: Bunker Ramo Corporation, Oak Brook, Ill.

[21] Appl. No.: 631,453

[22] Filed: Nov. 13, 1975

[51] Int. Cl.[2] ..... H01R 17/04

[52] U.S. Cl. ..... 339/177 R; 29/628; 174/89

[58] Field of Search ..... 339/177, 89 C, 94 C; 174/75 C, 89; 29/628

[56] References Cited

U.S. PATENT DOCUMENTS

| | | | |
|---|---|---|---|
| 2,805,399 | 9/1957 | Leeper | 339/177 E |
| 3,089,115 | 5/1963 | Wicks | 339/177 R |
| 3,465,281 | 9/1969 | Florer | 339/177 R |
| 3,781,762 | 12/1973 | Quackenbush | 339/177 R |

FOREIGN PATENT DOCUMENTS

| | | | |
|---|---|---|---|
| 655,989 | 3/1965 | France | 339/177 R |
| 621,459 | 4/1949 | United Kingdom | 339/177 R |
| 1,163,167 | 9/1969 | United Kingdom | 174/89 |

*Primary Examiner*—Roy Lake
*Assistant Examiner*—Neil Abrams
*Attorney, Agent, or Firm*—William Lohff; F. M. Arbuckle

[57] ABSTRACT

An electrical connector assembly for connection to a coaxial cable having a housing with a rear tubular metallic member having a pair of radially raised portions separated by a recessed peripheral surface portion for receiving the outer shield of the cable and an outer sleeve with an outwardly expandable section which is slid over one of the raised portions and shield and resiliently closes inwardly to press the shield against the recessed surface portion and axially retained between the pair of raised portions. An inner passageway in the tubular metallic member permits passage of the inner conductor and insulating member of the cable to within the connector housing. The sleeve is further provided with an enlarged front flange which acts with a flange on the housing to secure a radial portion of the shield and further acts with a front outwardly raised projection on the housing to axially retain a coupling ring on the housing.

39 Claims, 2 Drawing Figures

CABLE CONNECTOR

BACKGROUND OF THE INVENTION

This invention relates to an electrical connector assembly for connection to a coaxial cable and more particularly to an assembly in which the outer conductive shield of the cable is attached to the connector housing by an outer sleeve.

The attachment of coaxial cables to electrical connectors has often involved a variety of attachment techniques. In one technique, the outer shield of the cable is slid over a rear ferrule of the connector housing with the inner conductor and insulating member of the cable being inserted in a passageway in the ferrule and the conductor being attached to a center contact supported in the housing. An outer sleeve is slid over the shield and ferrule and crimped to force the shield against the ferrule. Often special crimping tools or apparatus have been required to provide a satisfactory attachment and reduce the possibility of damage to the ferrule. In another attachment technique, a nut or similar rotational member is rotationally coupled to a rear member of the connector housing forcing the shield to be confined between two surfaces in the housing. In some instances, a number of connector parts are required to isolate the rotational movement of the nut from the surfaces being forced against the shield.

SUMMARY OF THE INVENTION

The present invention is directed to providing an improved connector assembly in which attachment of the assembly to a coaxial cable does not require the use of special crimping tools or a rotational coupling member. The connector assembly of the invention includes a connector housing with a tubular member or ferrule provided with an outer peripheral surface portion to receive the outer shield of the cable and a pair of raised portions axially separated by the peripheral surface portion and advantageously extending transversely about the ferrule for capturing an outer expandable sleeve. The sleeve is formed with a resilient outwardly expandable section which after movement over the rear raised portion contracts to press the shield against the ferrule. In the attachment technique of the invention, the outer shield of the cable is moved axially over the rear raised portion to reach a position over the outer peripheral surface portion of the ferrule. The outer sleeve is then moved axially over the raised portion until the resilient section of the sleeve resiliently closes against the peripheral surface portion to secure the shield against the ferrule.

The inventive connector assembly advantageously further provides the rear raised portion in the form of a barb with a tapered surface extending from a rear position radially outwardly and frontwardly to the outer dimension of the barb as a guide means for expanding the resilient section of the sleeve over one of the outwardly raised portions. Advantageously, the resilient section of the sleeve includes at least one longitudinal slit to form a plurality of outwardly expandable resilient members preferably in the form of resilient fingers with rear free ends.

Another embodiment of the connector assembly of the invention includes an enlarged front member joined to the rear ferrule by a radial flange and inwardly supporting a center contact. The outer shield of the cable is radially folded to extend against the flange and the outer sleeve is formed with a front radial flange. By the attachment of the outer sleeve between the rear barb and radial flange of the connector housing, engagement of the resilient fingers with the inwardly tapered shield and outer jacket causes the sleeve to be forced axially frontwardly to press the shield against the radial flange of the housing in addition to the outer peripheral surface portion of the ferrule.

In yet another embodiment of the invention, a front coupling ring is retained on the enlarged forward member by a front raised projection and rearwardly by the radial flange of the sleeve for limiting axial movement of the ring.

The resultant connector assembly provides several advantages. One advantage is that the outer conductive shield is attached to a rear ferrule without the use of special crimping tools. Another advantage involves the attachment of the outer shield to the ferrule without damage to the ferrule. A further advantage involves attachment of the outer shield to the rear ferrule by an axial movement without any significant rotational movement. Yet another advantage involves the attachment of an outer shield against a plurality of surfaces in transverse planes to reduce any tendency of the cable to move or creep after attachment. Still another advantage involves a connector housing in which a rear stop or mounting abutment for the coupling ring is insertable after the ring is mounted and is in turn retained by a rear stop or abutment shoulder.

DESCRIPTION OF THE PREFERRED EMBODIMENTS

In the preferred embodiment, the connector assembly of the invention is illustrated as a plug or male member since plugs are frequently attached to cables in the field and connected to female connector members mounted on various types of electrical and electronic equipment. However, it is understood that the invention is not restricted to connector plugs. The electrical connector assembly of the invention is provided for connection to a coaxial cable including an outer conductor with an inner surface portion, an inner conductor, and an insulating member separating the outer and inner conductors; with the assembly including a connector housing having an axially extending rear tubular metallic member with an outer peripheral surface portion dimensioned to engage the inner surface portion of the outer conductor and an inner passageway dimensioned to receive the inner conductor and insulating member. Contact means are supported in a housing and first and second outer raised portions are spaced apart along the axis of the tubular member and separated by the outer peripheral surface portion on the rear tubular metallic member. A sleeve member includes an outwardly expandable resilient section expandable to move over one of the outer raised portions and the outer conductor to be disposed over said outer peripheral surface portion. After movement over the one raised portion, the resilient section closes inwardly towards its normal inner dimension to press the outer conductor against the outer peripheral surface portion. The invention advantageously utilizes a coupling ring disposed frontwardly on the connector housing and third and fourth outwardly raised portions supported by the sleeve and connector housing for axial retention of the coupling ring.

In the method of connecting the coaxial cable to the connector assembly of the invention, first and second outwardly raised portions are spaced apart axially on the tubular member and an outer peripheral surface portion is positioned between the raised portions. The shield on the coaxial cable is inserted over the first raised portion and disposed over the outer peripheral surface portion with the inner conductor and insulating member of the coaxial cable being positioned within the tubular member of the connector housing. Prior to disposing the shield over the outer peripheral surface, an outer sleeve having a rear outwardly expandable resilient section is slid rear end first over the cable, and disposition of the shield over the outer peripheral surface portion, the sleeve is slid in the opposite direction axially over the cable with the tubular member therein to a location beyond the first raised portion to axially reach a location over the outer peripheral surface portion with the resilient section thereafter compacting to press the shield against the outer peripheral surface portion and the sleeve being axially captured between the raised portions and the intervening cable material.

Figure 1:
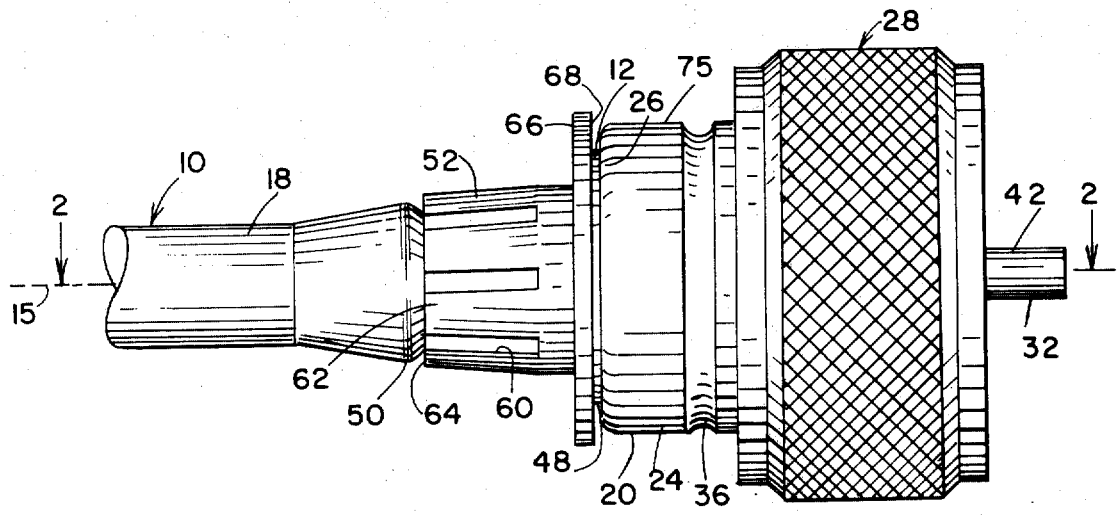
FIG. 1 is a side view of one embodiment of the connector assembly of the invention.
Figure 2:
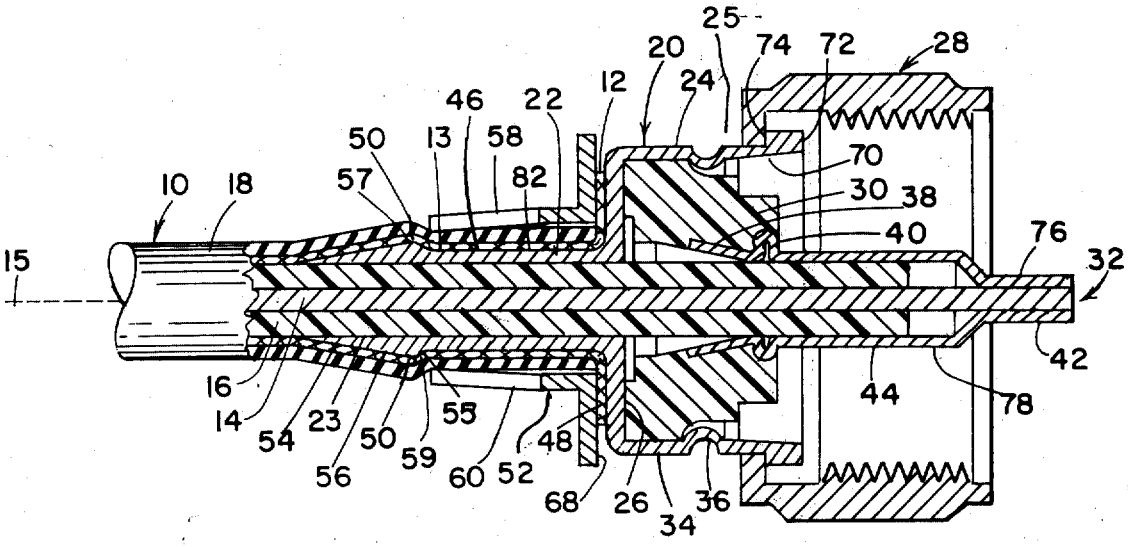
FIG. 2 is a sectional view along line 2—2 of FIG. 1.

As illustrated in FIGS. 1 and 2, the coaxial cable 10 includes a tubular outer conductive shield formed as a braid 12 and outwardly expandable, an inner conductor 14 extending along the axis 15 of the cable, an inner insulating member 16 separating the shield and inner conductor and an outer insulating jacket 18. The connector housing 20 is advantageously constructed of a conductive material such as brass and includes a rear tubular member 22 dimensioned to outwardly receive shield 12 and outer jacket 18 and having a passageway 23 inwardly dimensioned to permit passage of the inner conductor 14 and inner insulating member 16. Frontwardly on the connector housing 20 is front enlarged member 24 joined to rear member 22 by a shoulder formed by a radial flange 26. Coupling 28 is disposed about the enlarged member 24 for rotational coupling to a mating connector member (not shown).

Internally, the front enlarged member 24 includes an insulating insert 30 advantageously made of a plastic material and molded on inner contact 32 for support of the contact and secured in outer shell 34 by rolled or spun portion 36. Inner contact 32 is constructed of an electrically conductive material such as brass and includes a rear flared portion 38 to secure the contact against frontward movement and a radially folded portion 40 for securing the contact against rearward movement. Frontwardly contact 32 includes first and second tubular portions 42 and 44 respectively for attachment to inner conductor 14 and a mating socket contact (not shown) of a mating connector. Further, second tubular portion 44 serves to support and/or align inner insulating member 16 and the inner conductor 14 as illustrated in FIG. 2.

As illustrated in FIG. 2, tubular member 22 is provided with an outer peripheral surface portion 46 dimensioned to engage the inner surface portion 13 of shield 12. Advantageously, shield 12 is extended with a radial fold 48 and positioned against radial flange 26 to provide a plurality of surfaces in different planes for attachment of the shield against the connector housing. Longitudinally separated by the outer peripheral surface portion 46 are first shoulder or raised portion 50 advantageously in the form of a barb and the aforementioned shoulder or second raised portion advantageously in the form of radial flange 26.

Means for securing shield 12 to rear tubular member 22 is illustrated in the form of an outer sleeve 52 shown in FIG. 2 as being captured between barb 50 and radial fold 48 pressed against radial flange 26. Advantageously, guide means are provided to guide sleeve 52 over barb 50 to reach the outer peripheral surface portion 46. As illustrated in FIG. 2, guide means 54 is advantageously in the form of a tapered surface 56 on barb 50 and is tapered frontwardly and outwardly at an acute angle preferably about 10 degrees with barb 50 being shaped with a sharp change in direction 55 to cause shield 12 to taper inwardly when forced inwardly by sleeve 52 thereby causing sleeve 52 to press radial fold 48 of shield 12 against radial flange 26 to secure shield 12 against outer peripheral surface portion 46 and radial flange 26.

Outer sleeve 52 is dimensioned to be moved axially along rear tubular member 22 and over barb 50, shield 12, and outer jacket 18 to reach a position over outer peripheral surface portion 46. A rear resilient section 58 formed to be outwardly expandable by movement over barb 50 is provided and normally dimensioned to press shield 12 against outer peripheral surface portion 46. Advantageously resilient section 58 includes at least one longitudinal slit 60 and preferably a plurality of slits to form a plurality of resilient fingers 62 having rear free ends 64.

Frontwardly on sleeve 52 is provided an outer radial flange 66 to press radial fold 48 against radial flange 26 and as enlarged radially beyond the outer dimension 25 of enlarged member 24 (as illustrated in FIG. 2) serves as a rear stop 68 for coupling ring 28. Enlarged member 24 includes a front portion 70 with a second raised projection 72 to the projection represented by flange 66 to provide a front stop 74 for a coupling ring 28.

As illustrated in FIG. 2, inner contact 32 is provided with first and second tubular members 42 and 44 for respectively securing inner conductor 14 to the contact and for engaging an external mating socket contact. Advantageously, first tubular member 42 is of reduced dimension 76 to the dimension 78 of second tubular member 44 and thereby can be crimped or peened to retain the center conductor 14 without deforming or changing the outer dimension 78 of second tubular member 44. In the attachment of the coaxial cable 10 to the connector housing 20, the shield represented by radial fold 48 is stripped of outer jacket 18 and rearwardly shield 12 and outer jacket 18 are separated from inner insulating member 16. The separated and stripped shield 12 is inserted over tapered surface 56 and outer dimension 57 advantageously shaped as an edge extending transversely around tubular member 22. Sleeve 52 is moved axially forward without significant rotational motion with finger 62 sliding over tapered surface 56 and resiliently closing inwardly against insulating jacket 18 to press shield 12 against outer peripheral surface portion 46 which further acts to cause flange 66 to press radial fold 48 of shield 12 against flange 26.

Upon positioning of sleeve 52, flange 66 provides a rear stop 68 for capturing coupling ring 28 in recess 75 formed by flange 66 and raised projection 72.

As an example of the dimension of barb 50 and sleeve 52 and not for limiting purposes, edge 59 may have a flat portion of approximately 0.002 inches with a frontwardly facing shoulder 80 of a radial dimension of about 0.010 inches with resilient fingers 62 being about 0.026 inches thick.

As described above movement of sleeve 52 axially into the recess 82 formed by barb 50 and flange 26 provides a means for securing shield 12 on rear tubular member 22 and further provides a portion of the retaining means for coupling ring 28 by third and fourth raised portions 66 and 72 in which both advantages are provided in mechanical operation not requiring complicated tools.

We claim:

1. An electrical connector assembly for connection to a coaxial cable including outer cable material having an outer conductor with an inner surface portion, an inner conductor, and an insulating member separating said outer and inner conductors, comprising a connector housing including a rear tubular conductive member extending along a longitudinal axis and having an outer peripheral surface portion dimensioned for engagement with the inner surface portion of the outer conductor and an inner passageway dimensioned for receiving the inner conductor and insulating member, contact means mounted in said housing, first and second shoulders on said rear tubular conductive member spaced apart longitudinally and separated by and extending radially from said outer peripheral surface portion, and an elongate sleeve member for disposition about the cable at a position over said outer peripheral surface portion and including a rigid closed section and inwardly resilient section dimensioned for normally pressing against the outer material of the cable to urge said outer conductor against said outer peripheral surface portion and outwardly expandable to move axially over one of said shoulders to reach said position over said surface portion, the ends of said sleeve and said shoulders cooperable through the intervening cable material to hold said sleeve in axial retention and prevent retrograde movement of the cable.

2. The connector assembly of claim 1 including means acting via the cable disposed over the one shoulder to outwardly expand said resilient section of said sleeve member as it moves over said one shoulder.

3. The connector assembly of claim 2 wherein said resilient section includes at least one longitudinal slit and a plurality of rearwardly extending resilient fingers formed thereby.

4. The connector assembly of claim 2 wherein said outer conductor is outwardly disposed over said one shoulder with said one shoulder being rearwardly disposed from the other shoulder and including an outer edge adapted for engagement with said outer conductor, and said cable includes an outer insulating jacket with said resilient section being dimensioned and adapted for engagement with said outer jacket to press said outer conductor against said outer peripheral surface portion.

5. The connector assembly of claim 2 wherein said connector housing includes a front enlarged member including a front portion with an outer projection, said sleeve member includes a front portion with an outer raised projection rearwardly spaced from the projection of said enlarged member to form a recess therebetween, and wherein said assembly includes an outer coupling ring movable rotatably and axially on said enlarged member and limited in axial movement in said recess by said projections.

6. An electrical connector assembly for connection to a coaxial cable including outer cable material having a tubular outwardly expandable conductive shield with an inner peripheral surface portion and a normal inner dimension, an inner conductor and an insulating member separating said shield and conductor, comprising a connector housing including an elongate rear tubular conductive member extending along a longitudinal axis, a front enlarged member and an outwardly raised flange joining said rear and front members.

contact means supported in said front member for connection to the inner conductor, said rear conductive member including an outer peripheral surface portion dimensioned for engagement with the inner peripheral surface portion of said shield when expanded, an outer raised portion spaced longitudinally rearwardly from said raised flange to form an elongate recess along said outer peripheral surface portion of said rear member, and a sleeve member adapted for disposition about said cable and for movement to a position over said outer raised portion, with said shield disposed over said outer peripheral surface portion of said rear member in axial retention between said raised portion and said flange, and including a rigid closed section and a rear outwardly expandable resilient section with an inner peripheral surface portion inwardly biased and dimensioned for normally pressing said shield against said outer peripheral surface portion, said resilient section including at least one longitudinal slit defining a plurality of rearwardly extending resilient fingers which are outwardly expandable as said sleeve in moved over said raised portion and outer cable material, said raised portion and said flange cooperating through said outer cable material to retain said sleeve and the cable against axial movement.

7. The connector assembly of claim 6 wherein said outer raised portion includes a surface tapering frontwardly and outwardly and acting through the outer cable material to expand said resilient fingers over said raised portion and intervening cable material.

8. The connector assembly of claim 7 wherein said sleeve member includes an enlarged front portion for pressing a radially flared portion of said shield against said outwardly raised flange.

9. The connector assembly of claim 8 wherein said raised portion extends radially inwardly from said tapered surface at a sharp change in direction for causing said outer material to extend angularly inwardly to said outer peripheral surface portion and pressing said sleeve member axially against said radially folded shield portion.

10. The connector assembly of claim 9 including a coupling ring outwardly disposed about said enlarged portion, and cooperable retaining means both on said sleeve member and on said enlarged member for limiting the axial movement of said coupling ring.

11. The connector assembly of claim 10 wherein each of said retaining means includes a raised projections spaced apart longitudinally for retaining said coupling ring.

12. A connector assembly for connection to a multiconductor cable including outer cable material including an outer conductor, and an inner conductor, and an insulating member separating said conductors, comprising a connector housing including a tubular member extending along a longitudinal axis with an outer peripheral surface portion for electrically receiving and contacting said outer conductor, and an outwardly enlarged member, contact means supported in said enlarged member, a coupling ring disposed about said enlarged member and axially movable and rotatable thereon, first and second outwardly raised portions supported by said housing, spaced apart longitudinally and opposite adjacent said outer peripheral surface portion, an annular sleeve member including a rigid section and a resilient section having axially extending outwardly expandable fingers to move over the outer cable material at said first raised portion and inwardly biased to a normally reduced dimension for engaging the cable and urging said outer conductor against said outer peripheral surface portion, said sleeve retained against axial movement through the cooperation of said first and second raised portions and the cable material between said sleeve and said raised portions, and third and fourth outwardly raised portions supported by said sleeve member and said enlarged member, respectively, and spaced apart longitudinally on opposite sides of said coupling ring for axial retention of said coupling ring.

13. The connector assembly of claim 12 wherein said first raised portion includes means for expanding said resilient section, via the outer cable material, as said resilient section moves over said first raised portion.

14. The connector assembly of claim 13 wherein said contact means includes first and second tubular members of first and second outer dimensions, for respectively receiving said inner conductor of said cable and a socket contact of a mating connector, the first tubular member being of reduced outer dimension for being secured to said inner conductor without affecting the outer dimentison of said second tubular member.

15. An electrical connector assembly for connection to a cable including a first conductor, a first insulating member covering the first conductor, a second conductor carried on the first insulating member and a second insulating member carried over the second conductor, comprising:

a connector housing including a passageway therein to receive the first conductor and the first insulating member;

a contact supported by said housing and including a portion for receiving therein and contacting the first conductor;

said housing including an elongate tubular member for disposition about the first insulating member between the first insulating member and the second conductor, said elongate tubular member including an elongate conductive surface portion;

an elongate sleeve for disposition over said conductive surface portion with the second conductor and the second insulating member therebetween, said sleeve including a closed section and a resilient radially expandable section connected to said closed section and dimensioned to normally press the second conductor inwardly, via the second insulating member, against said elongate conductive surface portion of said tubular member; and cooperating sleeve retention means carried axially spaced apart on said elongate tubular member and on said elongate sleeve for interacting through the second conductor and the second insulating member to axially retain said sleeve over said conductive surface portion.

16. The electrical connector assembly of claim 15, wherein:

said electrical contact includes a first hollow portion of a predetermined cross-sectional dimension to receive the first conductor as said contacting portion, a second hollow portion of a greater predetermined cross-sectional dimension as a mating contact for engagement with a cooperable mating connector assembly; and a third hollow portion joining said first and second hollow portions and permitting a deformation type connection of the first hollow portion to the first conductor without affecting the cross-section and mating function of said second hollow portion.

17. The electrical connector assembly of claim 15, wherein:

said conductive portion of said housing includes a conductive first flange extending radially from and electrically connected to said elongate conductive surface portion of said tubular member for receiving a folded portion of the second conductor thereagainst; and said sleeve includes a second radially extending flange to bear against and clamp the folded portion of the second conductor against said conductive first flange.

18. The electrical connector assembly of claim 15, wherein:

said sleeve retention means comprises first and second radially extending shoulders spaced apart on said elongate tubular member; and third and fourth spaced apart shoulders on said sleeve respectively engaging said first an second shoulders via the intervening insulating and conductive material.

19. The electrical connector assembly of claim 18, wherein:

said first and second shoulders extend radially outwardly and said first shoulder includes a surface extending at an acute angle with respect to said elongate conductive surface portion; and said third and fourth shoulders comprise opposite end surfaces of said sleeve, said surface of said first shoulder acting through the intervening insulating and conductive material to urge said sleeve toward said second shoulder.

20. An electrical connection comprising:

a coaxial cable including an inner conductor, an outer conductive braid, an intermediate insulating member therebetween, and an insulating jacket covering said outer conductive braid, a conductive connector housing including a forward member having a forward stop and a tubular rear member said forward and rear members having different diameters, said tubular member including a radially outwardly extending raised portion, a radially extending first flange connecting said different diameter forward and rear portions, said first flange axially spaced from said raised portion, and an elongate surface between said raised portion and said first flange;

an insulator mounted in said connector housing and including a passageway therethrough;

a tubular electrical contact mounted in said insulator axially aligned with said passageway, said contact including a first diameter portion receiving said intermediate insulating member, and a second diameter portion receiving and connected to said inner conductor;

said braid extending over said tubular rear member and extending radially outwardly and bearing against said flange;

a coupling nut rotatable about said forward member for connection to a mating connector; and a sleeve disposed about said tubular member over said elongate surface, said sleeve including a circumferentially closed forward portion, a radially extending second flange bearing against said radially extending portion of said braid, and a resilient radially expandable rear portion connected to said forward portion including a plurality of axially and radially extending inwardly biased fingers each having rear surfaces, said fingers pressing against said insulating jacket to urge said braid against said elongate surface with said rear surfaces acting through said braid and outer jacket against said radially outwardly extending raised portion to urge said sleeve forward against said first flange to clamp said braid between said first and second flanges and to axially retain said sleeve and the cable.

21. A method of connecting a coaxial cable having outer cable material including an outer conductive shield, an inner conductor and an insultaing member separating the shield and conductor, to an electrical connector having a rear axially extending tubular member outwardly dimensioned to received the outer cable material including the shield and inwardly dimensioned to permit passage of the inner conductor and insulating member, comprising the steps of:

providing first and second outwardly raised portions spaced apart axially on the tubular member, and an outer peripheral surface portion between the raised portions, inserting the inner conductor and insulating member within the tubular member, positioning the outer cable material over the tubular member with the shield over the first raised portion and over the outer peripheral surface portion, and pressing the shield against the outer peripheral surface portion of the tubular member by axially sliding an outer sleeve having a closed rigid section and a rear outwardly expandable resilient section over the cable and the first raised portion to a position over the outer peripheral surface portion, to radially expand and then contract the resilient section as it moves over the first raised portion and the intervening outer cable material to press the outer cable material and urge the shield against the outer peripheral surface portion, and to axially capture the sleeve between the raised portions and the intervening outer cable material to prevent axial movement thereof.

22. The method of claim 21, wherein the coaxial cable has an outer insulating jacket, and the connector includes a contact having a large diameter portion sized to receive the intermediate insulating member and a small diameter portion sized to receive the inner conductor, and comprising the steps of:

stripping the insulating and conductive material back from the end of the inner conductor a first distance, stripping the outer braid back a second distance from the end of the inner conductor, stripping the outer insulating jacket back a third distance from the end of the inner conductor, inserting the end of the cable into the tubular member to position the stripped inner conductor within the smaller diameter portion and the intermediate insulating member within the large diameter portion of the contact while simultaneously flaring the stripped braid outwardly and urging the flared braid against the second projection with the stripped end of the outer jacket and, providing a radial projection on the sleeve which engages and presses and maintains the flared portion of the braid against the second projection when the sleeve is axially captured.

23. The method of claim 22, comprising the step of crimping the small diameter portion of the contact to the inner conductor.

24. An electrical connector assembly for connection to a cable including a first conductor, a second conductor surrounding the first conductor, a first insulating member between the first and second conductors, and a second insulating member carried over the second conductor, comprising:

a connector housing including a passageway therein to receive the first conductor and the first insulating member;

a contact supported by said housing and including a portion for receiving therein and contacting the first conductor;

an elongate tubular member for disposition about the first insulating member between the first insulating member and the second conductor, said elongate tubular member including an elongate conductive surface portion;

an elongate sleeve for disposition over said conductive surface portion with the second conductor and the second insulating member therebetween, said sleeve including a flange section and a resilient radially expandable section connected to said flange section and dimensioned to normally press the second conductor inwardly, via the second insulating member, against said elongate conductive surface portion of said tubular member with said flange section pressing a radially extending portion of the second conductor against said housing; and sleeve retention means carried axially spaced apart on said elongate tubular member and on said elongate sleeve for interacting through the second conductor and the second insulating member to axially retain said sleeve over said conductive surface portion.

25. A method of connecting a coaxial cable having outer cable material including an outer conductive shield, an inner conductor and an insulating member separating the shield and the inner conductor, to an electrical connector having a rear axially extending tubular member outwardly dimensioned to receive the shield thereover and inwardly dimensioned to permit passage of the inner conductor and the insulating member, comprising the steps of:

providing first and second outwardly raised portions spaced apart axially on the tubular member, and an outer peripheral surface portion between the raised portions, sliding an outer sleeve onto the cable, the sleeve having a rear outwardly expandable resilient section and a rigid forward section, inserting the inner conductor and the insulating member within the tubular member while disposing the outer cable material over the tubular member with the shield extending over the first raised portion and over the outer peripheral surface portion, and sliding the outer sleeve over the cable with the tubular member disposed therein to a position over the outer peripheral surface portion, with the resilient section expanding as it moves over the first raised portion and contracting as it passes the first raised portion to press the outer material and urge the shield against the outer peripheral surface portion adjacent the first raised portion and preventing retrograde movement of the cable from the tubular member.

26. The method of claim 25 including the steps of radially folding the shield against the second portion and axially sliding the sleeve against said folded shield pressing the shield against the second raised portion and against the outer peripheral surface portion.

27. The method of claim 26 including the steps of providing front raised first and second projections on said connector housing and said sleeve, respectively, providing said first raised portion with a tapered surface extending frontwardly and outwardly to an outer dimension of said portion, inserting a coupling ring axially over said raised portions to a position adjacent said first raised projection, and sliding said sleeve along said tapered surface and said outer dimension of said first portion to axially reach said outer peripheral surface portion and providing said second raised projection as a rear stop for said coupling ring.

28. A method of connecting a coaxial cable having outer cable material including a conductive shield, an inner conductor and an insulating member separating the shield and the inner conductor, to an electrical connector having a rear axially extending tubular member outwardly dimensioned to receive the outer cable material thereover and inwardly dimensioned to permit passage of the inner conductor and the insulating member, comprising the steps of:

providing a radially extending shoulder on the tubular member;

sliding a sleeve having a rigid forward section and rear axially and inwardly extending, inwardly biased resilient fingers, fingers first, over the cable;

inserting the inner conductor and the insulating member within the tubular member and positioning the outer cable material over the rear tubular member with the shield extending beyond the shoulder; and sliding the sleeve over the cable with the tubular member disposed therein to a position beyond the shoulder to outwardly expand the resilient fingers with the tubular member and the outer material of the cable, the fingers contracting inwardly under their bias as they pass the shoulder to press the outer material against the tubular member adjacent the shoulder to prevent retrograde movement of the cable.

29. An electrical connector assembly for a coaxial cable which has an inner conductor and outer material including a conductive braid coaxially disposed about and insulated from the inner conductor, said connector assembly comprising:

a connector housing including an elongate conductive tubular member for receiving the conductive braid thereabout, and a contact mounted in said housing for connection to the inner conductor;

braid expansion means on said tubular member for radially expanding the braid;

a first retaining shoulder on said tubular member adjacent said braid expansion means and a second retaining shoulder axially spaced from said first shoulder; and a closed sleeve for receiving the cable therethrough and slidable over the cable with the tubular member therein to a position between said shoulders, said sleeve including a rigid portion and a radially inwardly biased portion which is radially expanded by said braid expansion means and the cable material thereover as said sleeve is slid thereover toward said second shoulder and which radially contracts under its bias as it passes said first retaining shoulder to press the outer material against said tubular member adjacent the first retaining shoulder.

30. An electrical connector assembly for a coaxial cable which has an inner conductor and which has outer material including a conductive braid coaxially disposed about and insulated from the inner conductor and an outer insulating jacket covering the conductive braid, said connector assembly comprising:

a connector housing including an elongate conductive tubular member for receiving the conductive braid thereabout, and a contact mounted in said housing for connection to the inner conductor;

braid expansion means on said tubular member for radially expanding the braid and outer insulating jacket;

a first retaining shoulder on said tubular member adjacent said braid expansion means and a second retaining shoulder axially spaced from said first shoulder; and a closed sleeve for receiving the cable therethrough and slidable over the cable with the tubular member therein to a position between said shoulders, said sleeve including a rigid closed poriton and a radially inwardly biased portion which is radially expanded by said braid expansion means and the cable material thereover as said sleeve is slid thereover toward said second shoulder and which radially contracts under its bias as it passes said first retaining shoulder to press the jacket and braid to urge the inner surface of the braid against said tubular member adjacent said first retaining shoulder.

31. An electrical connector assembly for a coaxial cable which has at least one inner conductor and outer material including a conductive braid coaxially disposed about and insulated from the inner conductor, said connector assembly comprising:

a connector housing including an elongate conductive tubular member for receiving the conductive braid thereabout, and at least one contact mounted in said housing for connection to the inner conductor;

braid expansion means on said tubular member for radially expanding the braid;

a shoulder on said tubular member adjacent said braid expansion means; and a closed sleeve for receiving the cable therethrough and slidable over the cable with the tubular member therein to a position past and adjacent said shoulder, said sleeve including a closed rigid portion and a radially inwardly biased portion which is radially expanded by said braid expansion means and the cable material thereover as said sleeve is slid thereover and which radially contracts under its bias as it passes said shoulder to press the outer material against said tubular member adjacent said shoulder.

32. The electrical connector assembly of claim 31 wherein said tubular member includes a rear end and said braid expansion means includes an inclined surface extending from said shoulder radially inwardly and axially toward said rear end of said tubular member.

33. The electrical connector assembly of claim 31, wherein said radially inwardly biased portion of said sleeve includes a plurality of axially and inwardly extending resilient fingers.

34. The electrical connector assembly of claim 31, wherein said connector housing includes a radially extending surface for receiving a radially flared portion of the conductive braid thereagainst, and said sleeve includes an end portion for clamping the flared portion of the conductive braid against said radially extending surface of said connector housing.

35. The electrical connector assembly of claim 34, wherein said end portion of said sleeve comprises a radially extending projection.

36. The electrical connector assembly of claim 31 wherein said connector housing includes a forward end and a radially extending projection at said forward end, said sleeve includes a forward end and a radially extending projection at said forward end, and further comprising a coupling ring rotatably mounted about said forward end of said connector housing and limited in axial movement by said projections.

37. In an electrical connector of the type wherein the outer material, including a conductive shield, of a cable is received over, expanded by, and clamped about a rear tubular member of the electrical connector which has a radially extending shoulder, the improvement comprising:

a closed sleeve adapted to receive the cable therethrough before positioning of the outer material over the tubular member, said sleeve including a closed rigid portion and a radially inwardly biased portion which has a normal cross-sectional dimension which is less than the corresponding cross-sectional dimension of the expanded portion of the outer material of the cable, said biased portion responsive to movement over the tubular member to expand radially outwardly and to contract radially inwardly as it passes the shoulder to press the outer material against the tubular member adjacent the shoulder.

38. The improved electrical connector of claim 37 wherein said sleeve comprises at least one longitudinally extending slit rearwardly of said closed portion defining rearwardly and radially inwardly extending fingers which constitute said biased portion.

39. A sleeve for clamping the outer material of a cable adjacent a radially extending shoulder of a tubular member of an electrical connector housing, the outer material being expanded by the tubular member as it is received thereover, said sleeve comprising:

a hollow, rigid, peripherally closed section having an inner cross-sectional dimension adapted to receive the expanded portion of the cable therethrough including a forwardly facing surface; and an inwardly biased resilient section connected to said closed section and having at least one end surface and having a normal inner cross-sectional dimension which is less than that of the expanding portion of the cable, said resilient section urged outwardly by the expanded portion of the cable as said resilient section is moved thereover and urged inwardly by its bias as it passes the shoulder, whereby the end surface cooperates with said forwardly facing surface to clamp the outer material against the tubular member adjacent the shoulder and prevent retrograde movement of the cable.

* * * * *